United States Patent [19]

Sartore

[11] 3,943,948

[45] Mar. 16, 1976

[54] CASE WITH CLOSEABLE LID

[76] Inventor: James J. A. Sartore, Albany, N.Y.

[22] Filed: July 15, 1974

[21] Appl. No.: 488,270

[52] U.S. Cl. ..... 132/73; 30/28

[51] Int. Cl.[2] ..... A45D 29/00

[58] Field of Search ..... 132/73, 73.5, 75; 30/284, 30/27, 28, 143

[56] References Cited

UNITED STATES PATENTS

| | | | |
|---|---|---|---|
| 2,799,923 | 7/1957 | Senshu | 30/28 |
| 3,169,312 | 2/1965 | Fink | 30/28 |
| 3,180,025 | 4/1965 | Tsunemi | 30/28 |
| 3,316,634 | 5/1967 | Bliss | 30/143 |
| 3,712,311 | 1/1973 | Hedu | 132/73 |

*Primary Examiner*—G. E. McNeill

[57] ABSTRACT

A case comprised of a generally longitudinally tubular portion in which a nail clip can be inserted therein. Conforming to the same general outline of the nail clip which it houses and shell-like in appearance to it. Having internal pressure catches to captively hold the nail clip in place. With provision in its top wall to allow for the free movement of the operating handle and provision for a file, placed on a transverse to the longitudinal portion. Also containing a closeable and sealable front lid.

16 Claims, 6 Drawing Figures

CASE WITH CLOSEABLE LID

BACKGROUND OF THE INVENTION

This invention relates to an improved case which can be easily fitted over and hold a nail clip. It will allow the function of the nail clipping and manicuring operation to be carried out unimpeded. It will also function to control and contain the waste clippings produced during the nail clipping operation. A front lid is also provided to allow the front opening to be closed and sealed when not in use.

Although it is appreciated that efforts to devise such a device have been made, as shown in U.S. Pat. No. 3,180,025, issued on Apr. 27, 1965 to Yasuhiko Tsunemi, many problems and limitations exist. Problems such as complexity of the device itself, number and type of component parts required and the type of materials required, can be seen. These problems however, do not demonstrate themselves in the improved invention, due to the uncomplicated form utilized.

Some other problems which this invention solves are: It confines nail clippings within until there disposal can be properly taken care of, keeping the environment clean.

Another problem is safety, covering the cutting jaws prevents the sharp corners and edges from coming in contact with pocket or purse and possibly causing injury to persons or things.

Other benefits will become apparent during this disclosure.

SUMMARY OF THE INVENTION

This invention is a new, improved and novel nail clip case with closeable and sealable front lid. It comprises a generally two piece construction comprising a wraparound generally tubular case portion. Being shell-like in appearance to a nail clip, completely encircling the upper and lower nail clip members and forming two side walls. A front hinged type closeable and sealable lid is also used and they can be made of any material desired. The generally tubular portion containing in its top wall provision for a file and provision for allowing free movement of the operating handle with internal catches to hold it in place.

A removable, generally tubular case portion which remains in place during the nail clipping operation. Having a rear opening to facilitate the removal of the nail clip inserted therein and acting as a lock if the nail clip contains provision for a keeper.

The principle objective of this invention is to maintain a clean environment. This is accomplished by closing the open sides of the nail clip to the outside surroundings. This results in the nail clippings being controlled and contained during and following the nail clipping operation. Proper disposal of the waste clippings can then take place.

A further objective is personal health and safety. By preventing the waste clipping from being indiscriminately dispersed into things such as food which can be taken internally a possible health problem could be prevented.

Another objective is personal safety. Since the jaws contain sharp edges and corners used for cutting it is possible someone may grasp the cutters injuring themselves. This invention will prevent this.

Another objective is damage prevention to articles such as pocket or purse.

These and other objects and advantages of the invention will become apparent after a study of the appended drawings and after reviewing the written specification describing the preferred enbodiment. Like numerals are employed to designate like parts throughout same.

DESCRIPTION OF THE PREFERRED ENBODIMENT

Figure 1:
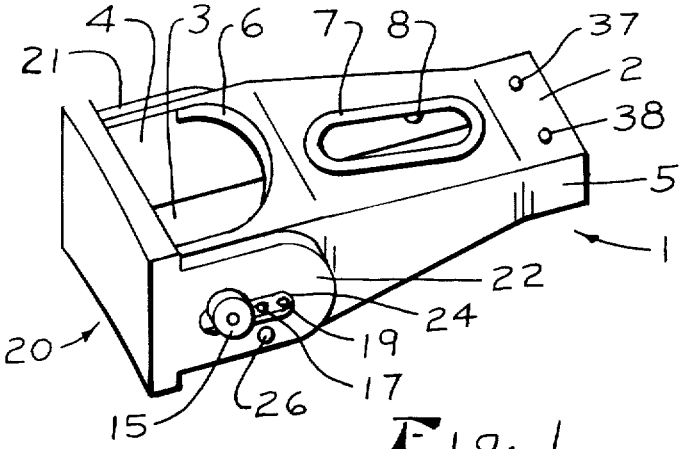
FIG. 1 is an isometric view showing the nail clip case with the lid in the closed position.
Figure 4:
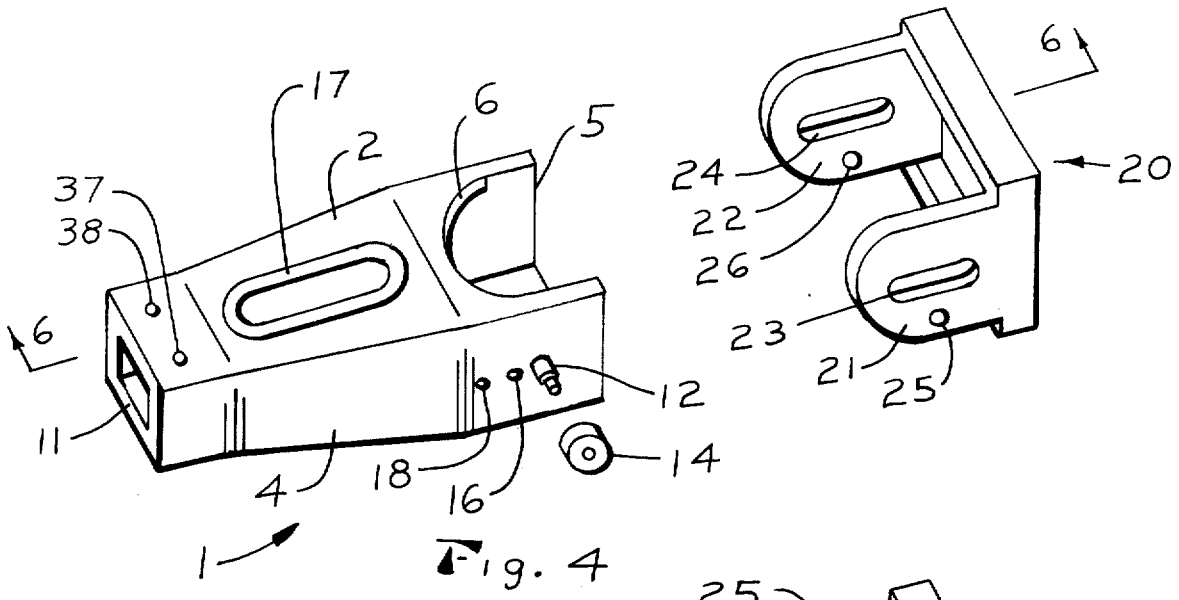
FIG. 4 is an isometric view showing the top of the case and lid parts previous to assembly.
Figure 5:
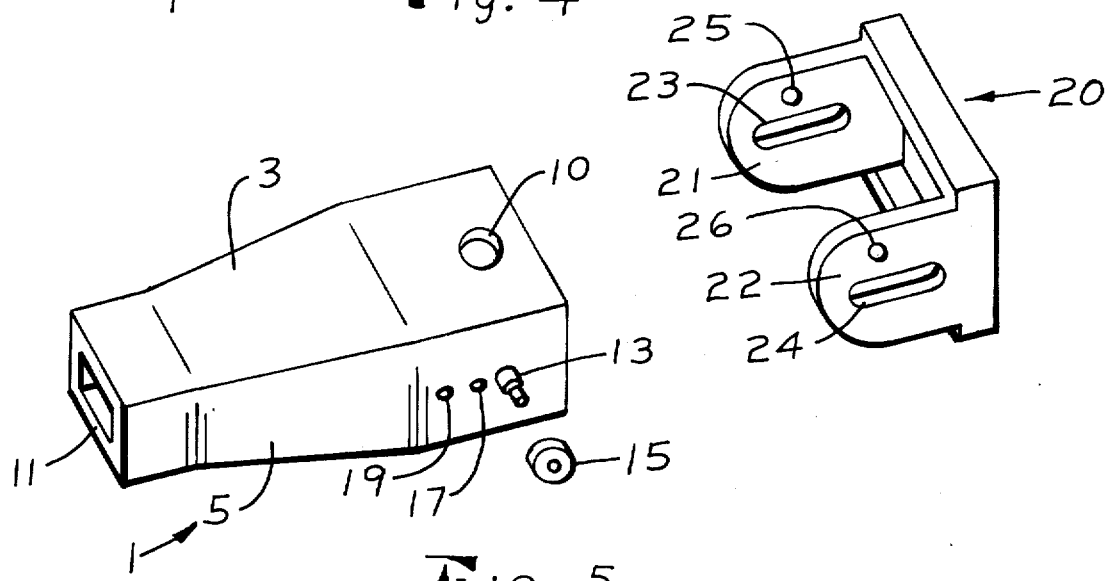
FIG. 5 is and isometric view showing the bottom parts of the case and lid previous to assembly.

Referring to the drawings in general and particularly to FIG. 1 of the drawings there is shown the new case with closeable and sealable lid for a nail clip which comprises a generally tubular case portion, shown generally by the numeral 1 which can be formed of plastic or any material desired. Each part may be constructed in a one piece configuration shown in FIGS. 4 and 5 or may be constructed in more than one piece by providing manufactured joints where required. Also comprised of a front lid 20 which is hingedly attached to side walls 4 and 5 by means of shafts 12 and 13. Then hinges 21 and 22 are maintained in place by shaft tops 14 and 15.

Figure 2:
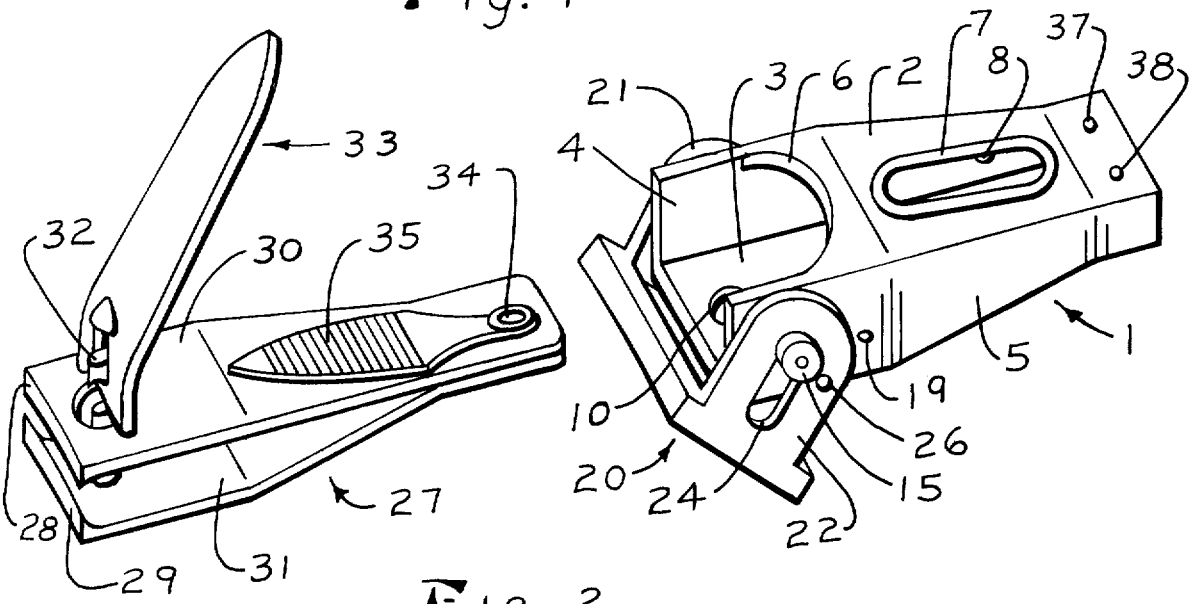
FIG. 2 shows isometric views of this invention with the lid lowered and a nail clip, both in proper alignment previous to joining.
Figure 3:
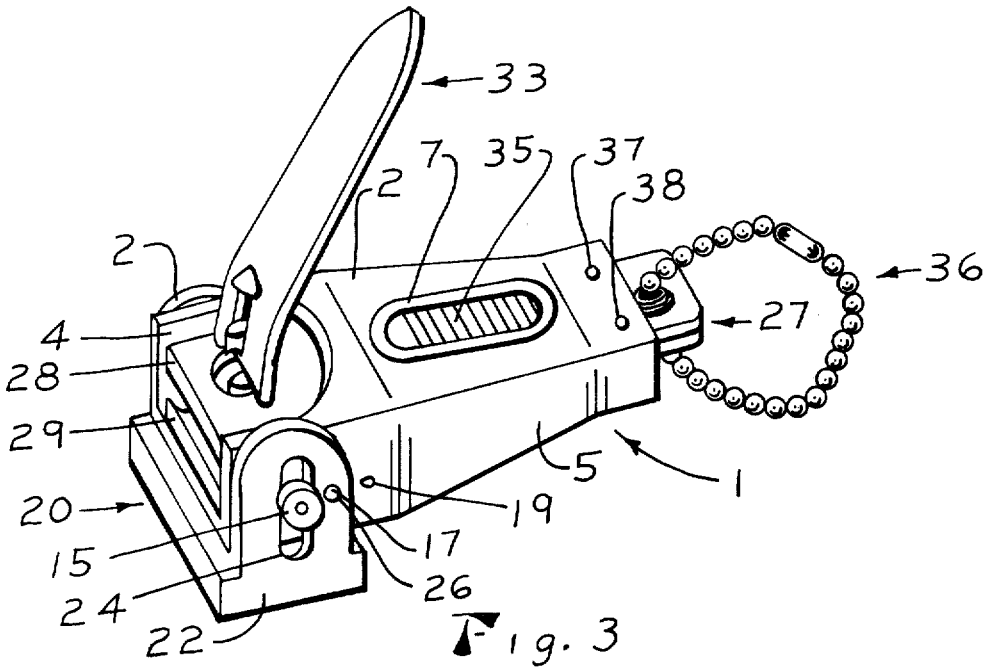
FIG. 3 is an isometric view showing this invention with the lid open, fully combined with the nail clip and in place for the nail clipping operation.

The generally tubular portion is comprised of a top wall 2 having provision to allow for the free movement of the operating handle 6 and not damage the case as shown in FIG. 3, provision for a file 7 and operating handle stops 37 and 38 to prevent lateral movement when the operating handle is placed between them. Two side walls 4 and 5 containing internal knob like catches 8 and 9 to grasp the bifurcated portion of the nail clip 27 to hold it in place, along with the bottom opening 10 in the bottom wall 3 to form a pressure lock with operating handle rivet 32 making contact with nail clip lower member 31 as shown in FIGS. 2 and 3.

Aligning nail clip 27 with the case 1 as in FIG. 2 will allow them to be joined to form a single unit as in FIG. 3. The nail clip upper and lower members 30 and 31 become part of the case 1, having the side walls 4 and 5 close the open sides of the mail clip forming an internal confined area to controll and contain the random indiscriminate dispersion of waste clippings into the surroundings. The nail file 35 will become exposed through the provision for a file 7.

The nail clip end opening 34 extends beyond the rear opening 11 forming a push to release type cobination to facilitate the removeal of the nail clip 1 when desired. Inserting a keeper 36 through the nail clip end opening 34 forms a lockable combination with the rear opening 11. The operating handle 33 can then be used as before for the nail clipping operation.

Figure 6:
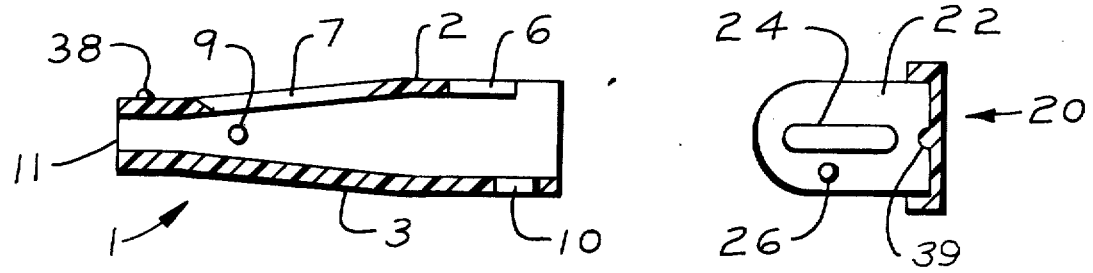
FIG. 6 is a sectional view taken along line 6—6 of FIG. 4.

Lid 20 with hinges 21 and 22 are comprised of slotted openings 23 and 24, which travel on shafts 12 and 13 built into side walls 4 and 5 along with restraining open knobs 16 and 17 and closed knobs 18 and 19 to hold the lid in position, when they mate with hinge openings 25 and 26 and slotted openings 23 and 24 as shown in FIGS. 1 and 3. A lid bit 39 is formed inside the lid to seal off the upper and lower jaws 28 and 29 opening as shown in FIG. 6.

It is to be understood that the aforementioned invention herewith shown and described is to be taken as a preferred example of the same and that various changes relative to material, size, shape and arrangement of parts may be resorted to without departing from the spirit of the invention and the subjoined claims.

What I claim is:

1. A case adapted to contain a nail clip and the waste clippings produced, said nail clip being generally comprised of: upper and lower nail clip members fastened at one end forming a bifurcated portion, whose opposite end contains jaws spaced apart and formed in opposing relationship to each other, tied together by means of an operating handle rivet and operating handle, said operating handle rivet being placed through aligned openings located near said jaws, controlling the movement of said jaws through said nail clip members which are fastened at said one end;

wherein the improvement comprises, a generally tubular case portion formed of top, bottom and two side walls in continuous relationship with each other, having front and rear openings running through the longitudinal portion;

inserting a nail clip into said case forms a united combination, held together by internal means or knob like catches with two contiguous relationships resulting, one between the said top case wall which contains: provision to allow for free movement of the operating handle in its front portion, provision for a file placed at the file location and having two operating handle stops mounted on said top wall, to prevent lateral movement when the operating handle is placed between them, said top wall abutting a nail file below and upper nail clip member, a second relationship being formed between the bottom case wall and the lower nail clip member, the said bottom case wall containing a bottom opening to receive the bottom of said operating handle rivet with said case side walls enclosing the space between said nail clip members, forming a receptacle for the waste clippings produced;

said case rear opening allowing the nail clip end to jut out the case rear opening exposing the nail clip end and nail clip end opening which can contain a keeper, each said side wall containing a shaft, one open and one closed knob mounted thereon;

a slotted type double hinged front lid being attached to said shafts and secured by shaft tops restricting the play in the hinges by sandwiching them between said shaft tops through said shafts and said case side walls, said hinges containing hinge openings strategically placed to mate with said open knobs mounted on said case side walls forming catches to hold the front lid open;

said closed knobs being so placed to mate with the rear sections of the said hinge slotted openings forming catches holding the said front lid in the closed position, whereby the internal portion of the said front lid which contains a lid bit will be held in an abutting relationship to seal the said walled portion of said front case opening and nail clip jaws.

2. Case with closeable and sealable front lid of claim 1 conforming to the same general outline of the nail clip which is covered and shell-like in appearance, having case openings provided where required.

3. Case with closeable and sealable front lid of claim 1 being of a lockable nature wherein, internal case pressure catches are provided to engage the bifurcated potion of the nail clip and utilizing a keeper in the nail clip end opening to lock the said case in place.

4. Case with closeable and sealable front lid of claim 1 wherein a slotted type hinged front lid is maintained in either the open or closed position by the use of knob like catches mating with openings forming a pressure holding type combination.

5. Case with closeable and sealable front lid of claim 2 wherein the provision for free movement of the operating handle consists of a simi circular recessed opening.

6. Case with closeable and sealable front lid of claim 2 where the case top wall contains provision for a file consisting of a slotted opening running transverse to the longitudinal portion.

7. Case with closeable and sealable front lid of claim 3 wherein the generally tubular case portion may be fixedly locked into position by attaching either the top or bottom wall of said case, to the corresponding upper or lower member of the nail clip or to both members if said case is of a flexible nature.

8. Case with closeable and sealable front lid of claim 2 wherein a push to release type combination is formed by the distance between the rear opening of the generally tubular case portion and the nail clip end to facilitate their separation and removeal.

9. Case with closeable and sealable front lid of claim 6 having provision for a file placed either inside or above the top wall of the generally tubular case portion.

10. Case with closeable and sealable front lid of claim 4 wherein a slotted type hinged front lid contains a bit to seal the opening between the nail clip jaws.

11. Case with closeable and sealable front lid of claim 8 wherein the internal case portion will accept and hold similar nail clips with ease.

12. Case with closeable and sealable front lid of claim 2 wherein the case portion can have a one piece configuration or construction.

13. Case with closeable and sealable front lid of claim 4 wherein the slotted type front lid is enclosed about its perimeter and this enclosure abuts the perimeter of the case which it covers, when in the closed position.

14. Case with closeable and sealable front lid of claim 9 wherein the file inside the case, abuts provision for a file, is flat, having a non interfering exterior, tapered at one end whose opposite end forms an opening, said file being placed on top of and abuting the upper nail clip member, said file being attached to said nail clip using aligned nail clip end opening and said file opening, fastened by means of a tubular rivet through said openings and maintaining the said nail clip end opening.

15. A case adapted to contain a nail clip and the waste clippings produced, said nail clip being generally comprised of elongated nail clip members fastened at one end forming a bifurcated portion btween the said nail clip members, having jaws formed in opposing relationship at their opposite end which are controlled by and operating handle in conjunction with an operating handle rivet placed through aligned openings near said jaws;

wherein the improvement comprises, a case having top, bottom, rear and two side walls in continuous relationship with each other, forming an internal portion which a nail clip can be inserted therein, said side walls having knob like catches to hold it in place;

two relationships will result, one between the said top case wall, nail file and upper nail clip member, another between the said bottom case wall and lower nail clip member, said top wall containing provision to allow for free movement of the operating handle in its front portion, provision for a file placed at the file location and having stops to restrict lateral movement of the operating handle when placed between them, said bottom case wall having a bottom opening to hold the bottom of the operating handle rivet and allow said bottom case wall to seat properly;

said side walls containing shafts on which is attached a double hinged type lid containing slotted openings and held by shaft tops placed on the said shaft ends, said hinges being effectively sandwiched between the said shaft tops and said case side walls by means of said shafts, mounted on said case side walls;

said side walls containing open knobs and the said slotted hinge containing openings strategically placed so as to mate with said open knobs forming catches and holding the said lid open, closed knobs also located on the said side walls of said case to mate with the rear sections of said hinge slotted openings forming catches and maintaining the lid in the closed position, in this closed position the internal portion of said lid which contains a bit, abuts the walls of the said front opening with the bit abutting and sealing the space between the said nail clip jaws.

16. Case with closeable and sealable front lid of claim 15 further comprising a case rear walled section to enclose the nail clip end, a generally tubular wrap-around flexible said case portion attached to the nail clip members and having a hinged type front lid.

* * * * *